US005109143A

United States Patent [19]

Gallup

[11] Patent Number: 5,109,143

[45] Date of Patent: Apr. 28, 1992

[54] GAS DAMPING CONTROL ASSEMBLY FOR DECELERATION SWITCH

[75] Inventor: David F. Gallup, San Dimas, Calif.

[73] Assignee: TRW Technar Inc., Irwindale, Calif.

[21] Appl. No.: 616,372

[22] Filed: Nov. 21, 1990

[51] Int. Cl.[5] ..... H01H 35/14

[52] U.S. Cl. ..... 200/61.45 R; 200/61.53

[58] Field of Search ..... 200/61.53, 61.45 R, 200/61.48; 307/121

[56] References Cited

U.S. PATENT DOCUMENTS

| | | | |
|---|---|---|---|
| 4,092,926 | 6/1978 | Bell | 102/204 R |
| 4,536,629 | 8/1985 | Diller | 200/61.45 R |
| 4,706,990 | 11/1987 | Stevens | 280/734 |
| 4,885,439 | 12/1989 | Otsubo | 200/61.45 R |
| 4,929,805 | 5/1990 | Otsubo | 200/61.45 R |
| 5,017,743 | 5/1991 | Gunning et al. | 200/61.45 R |

*Primary Examiner*—J. R. Scott

*Attorney, Agent, or Firm*—Tarolli, Sundheim & Covell

[57] ABSTRACT

A gas damped deceleration switch activates a vehicle occupant safety device in response to deceleration of a vehicle. The deceleration switch comprises a mass supported for movement in response to deceleration. A base structure has surfaces defining a chamber and a gas flow inlet communicating with the chamber. A pressure reduction is caused in the chamber in response to movement of the mass. The pressure reduction in the chamber restrains movement of the mass and causes a flow of gas into the chamber through the inlet. A movable control member controls the pressure reduction and movement of the mass by adjusting the flow of gas into the chamber through the inlet. The control member is slidable across the inlet to control a flow of gas into the inlet. A spring biases the movable control member into slidable contact with the base structure.

21 Claims, 8 Drawing Sheets

GAS DAMPING CONTROL ASSEMBLY FOR DECELERATION SWITCH

FIELD OF THE INVENTION

The present invention relates to a gas damped deceleration switch that responds to deceleration of a vehicle to activate a vehicle occupant safety device such as an airbag inflator.

BACKGROUND OF THE INVENTION

Gas damped deceleration switches that activate an airbag inflator in a vehicle in response to vehicle deceleration are known. One such gas damped deceleration switch is shown in copending U.S. Pat. application Ser. No. 664,497, filed Mar. 5, 1991, and assigned to the present assignee, which is a continuation of U.S. Pat. application Ser. No. 491,450, filed Mar. 9, 1990, now abandoned. The gas damped deceleration switch shown in the co-pending application is an electrical switch comprising a mass supported for movement in response to vehicle deceleration. The mass is spring biased into a rest position, and is movable against the bias of the spring toward an electrical contact. When moved to the electrical contact by deceleration of the vehicle, the mass and the electrical contact complete an electrical circuit to energize an airbag inflator.

The deceleration switch disclosed in the co-pending application further comprises a movable damping member which is connected to the mass for movement with the mass, and a stationary base structure defining a cavity. When the mass is in the rest position, the movable damping member is held in engagement with the base structure to define a closed volume within the cavity between the base structure and the damping member. As the damping member is carried by the mass away from the base structure, the closed volume between the base structure and the damping member is enlarged. Enlargement of the closed volume creates a pressure reduction within the closed volume, and thus creates a relative vacuum within the closed volume. The vacuum results in a pressure differential acting across the moving damping member. This pressure differential results in a damping force acting against the moving damping member. The damping force resists movement of the mass toward the electrical contact.

If deceleration of the vehicle is of sufficient magnitude and duration, the mass will be moved against the damping force, as well as against the bias of the spring, to carry the damping member away from the stationary base structure and to open the closed volume between the damping member and the base structure. Thus, the vacuum will no longer exist. Further movement of the mass and the damping member is resisted by the continuing bias of the spring, and by a minimal amount of damping force as required to displace the gas around the moving damping member. If deceleration of the vehicle is not of sufficient magnitude and duration to cause the moving mass to overcome the damping forces, the moving mass and damping member will be moved back into their rest positions by the bias of the spring.

The deceleration switch disclosed in the co-pending application includes a passage that enables a flow of gas to be directed into the closed volume in response to the relative vacuum created in the closed volume, and a valve for adjusting the size of a gas flow space in the passage. The valve comprises a cap having threads engaged with threads on the base structure. Rotation of the cap in one direction enlarges the gas flow space, and rotation of the cap in the other direction reduces the gas flow space. For a given rate of movement of the mass, the rate at which a vacuum is generated, and consequently the degree to which the vacuum will restrain movement of the mass, is increased by decreasing the size of the gas flow space. For the same rate of movement of the mass, the rate at which a vacuum is generated, and consequently the degree to which the vacuum will restrain movement of the mass, is decreased by increasing the size of the gas flow space. The valve thus regulates the degree to which the vacuum will restrain movement of the mass. The deceleration switch can thus be calibrated by adjusting the valve.

SUMMARY OF THE INVENTION

In accordance with the present invention, a gas damped deceleration switch comprises a mass and a base structure. The mass is supported for movement from a rest position to an activated position in response to deceleration. The base structure has surfaces defining a chamber and a gas flow inlet communicating with the chamber. A pressure reduction is caused in the chamber in response to movement of the mass. The pressure reduction in the chamber restrains movement of the mass, and causes a flow of gas into the chamber through the inlet. The deceleration switch further comprises means for controlling the pressure reduction and movement of the mass by adjusting the flow of gas into the chamber through the inlet. The controlling means comprises a movable control member and a supporting means. The movable control member overlies the inlet. The supporting means supports the control member for sliding movement relative to the base structure in a direction laterally across the inlet. The position of the control member affects the gas flow to the inlet past the control member. The switch is thus calibrated by sliding the control member on the base structure.

In the preferred embodiment of the present invention, the movable control member is a rectangular block having a longitudinal axis, a transverse axis perpendicular to the longitudinal axis, and a control surface. The block is supported in slidable contact with the base. The control surface is elongated along the longitudinal axis, and is inclined relative to the longitudinal axis. The control surface is spaced a distance from the inlet in a direction parallel to the transverse axis. Sliding movement of the block laterally across the inlet changes the distance from the control surface to the inlet. Sliding movement of the block thus controls the flow of gas to the inlet between the control surface and the inlet.

Further in accordance with a preferred embodiment of the present invention, the deceleration switch comprises a spring mean for biasing the movable block into slidable contact with the base structure. The supporting means comprises a bracket on the base structure. The spring means comprises a flexible arm of the bracket extending across the movable block. The movable block is engaged between the flexible arm of the bracket and the base structure under a biasing force of the flexible arm. The flexible arm thus holds the movable block firmly against the base structure during sliding movement of the block.

The present invention enables a gas damped deceleration switch to be calibrated with a great degree of accuracy. The control surface on the movable block can be formed with only a slight angle of inclination relative to the longitudinal axis of the block. The distance from the control surface to the inlet would then change only slightly in response to a relatively greater amount of sliding movement of the block along the longitudinal axis. A fine adjustment of the gas damping forces can therefore be made with the sliding block.

Furthermore, the present invention permits reasonable tolerances for the pieces involved and is therefore suitable for large volume production. The friction that resists sliding movement of the block on the base structure is related to the spring force exerted by the flexible arm of the bracket. The flexible arm can push the block against the base structure throughout a wide range of flexible movement of the arm in order to compensate for manufacturing tolerances in the block, the base, and the bracket. The spring force exerted by the flexible arm will not differ substantially throughout the range of flexible movement of the arm. The spring force exerted by the flexible arm therefore will not differ substantially between individual mass produced sensors.

BRIEF DESCRIPTION OF THE DRAWINGS

These and other features of the present invention will become apparent to those of ordinary skill in the art upon reading the following description of a preferred embodiment of the invention in view of the accompanying drawings, wherein.

DESCRIPTION OF A PREFERRED EMBODIMENT

Figure 1:
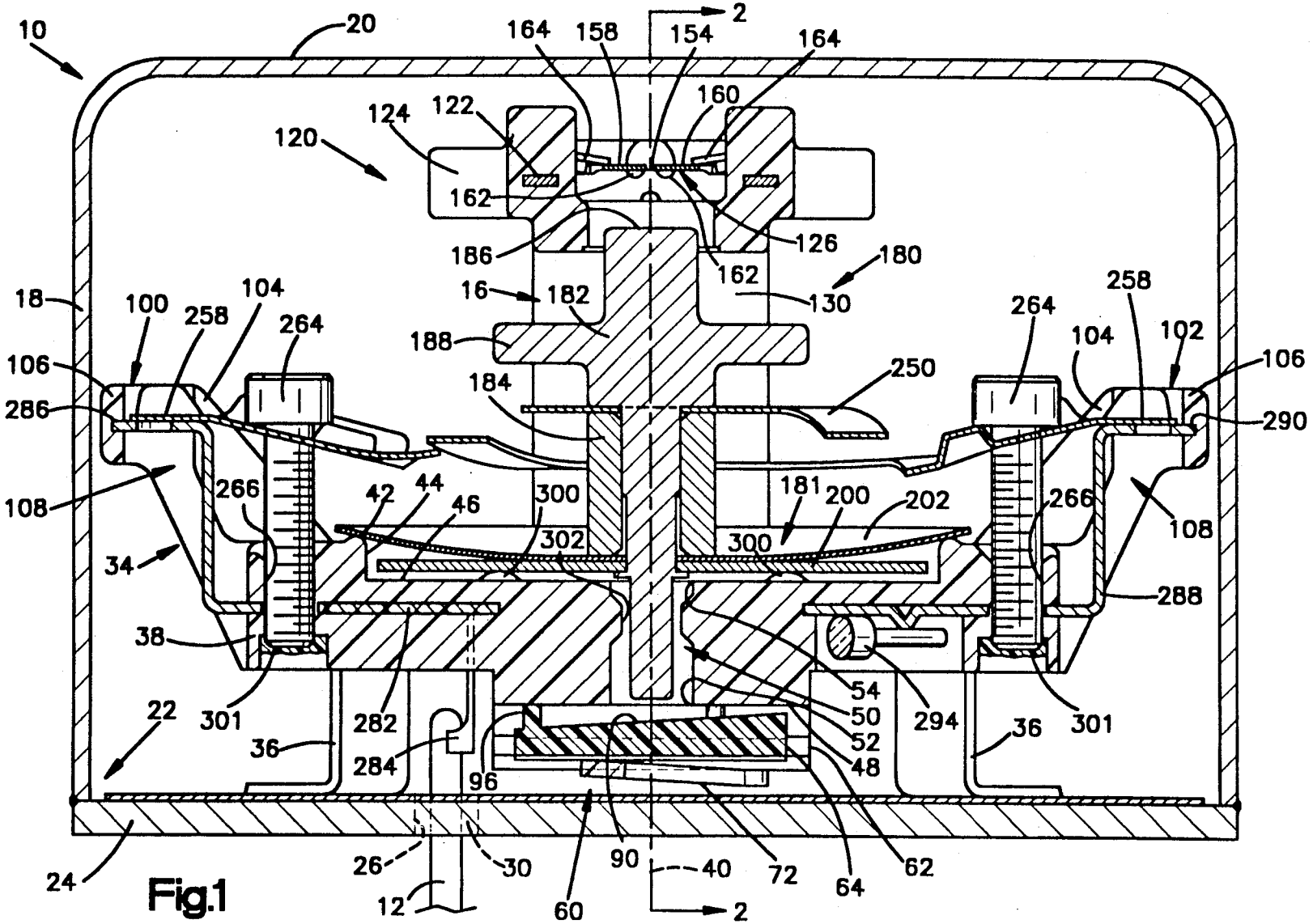
FIG. 1 is a sectional view of a gas damped deceleration switch in accordance with the present invention.

In accordance with a preferred embodiment of the present invention, a gas damped deceleration switch comprises a housing 10. The deceleration switch is an electrical switch having a pair of electrical current carrying pins 12 and 14 (see FIGS. 1 and 2) for connecting the deceleration switch to an electrical circuit associated with a vehicle occupant safety device, such as an airbag inflator. A mass 16 is supported for movement in the housing 10 in response to deceleration. The mass 16 is movable from a rest position to a firing position in which the mass 16 shorts across a resistor 294 in the circuit between the two pins 12 and 14 to energize the safety device.

Structure

The housing 10 comprises a cylindrical cap 18 having a closed upper end 20 and an open lower end 22. A circular metal chassis 24 is attached to the cap 18 and hermetically seals the open lower end 22 of the cap 18. The chassis 24 includes pair of apertures 26 and 28 through which the pins 12 and 14, respectively, extend. Glass seals 30 and 32 hermetically seal the apertures 26 and 28.

A plastic molded base 34 is rigidly supported in the housing 10 by four metal mounting supports 36 that connect the base 34 to the chassis 24. The base 34 comprises a substantially circular base platform 38 having a central axis 40. The top side of the base platform 38, as shown in the drawings, comprises a raised surface defining a circular rim 42, a cylindrical surface 44, and a recessed surface 46. The cylindrical surface 44 and the recessed surface 46 define a cavity radially inward of the circular rim 42. The bottom side of the base platform 38 comprises a bottom surface 48. The base platform 38 further comprises an inner surface defining a gas flow passageway 50 extending axially through the base platform 38. The gas flow passageway 50 has an inlet 52 on the bottom side of the base platform 38 at the bottom surface 48, and has an outlet 54 on the top side of the base platform 38 at the recessed surface 46.

A gas damping control assembly 60 is located at the bottom side of the base platform 38. As shown in FIGS. 1–5, the gas damping control assembly 60 comprises a bracket structure 62 and a control member 64. The bracket structure 62 and the base platform 38 are formed together as one plastic molded piece. The control member 64 is supported for sliding movement in the bracket structure 62.

Figure 6:
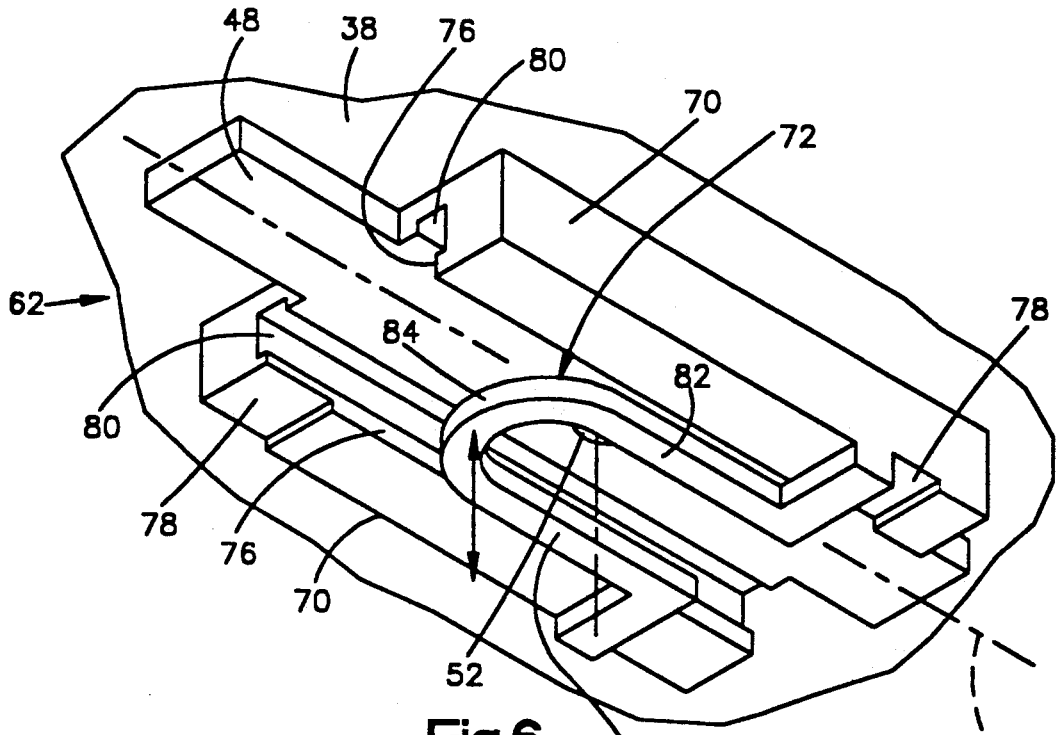
FIG. 6 is a partial perspective view of a part of the gas damped deceleration switch of FIG. 1.

As shown in FIG. 6, the bracket structure 62 comprises the bottom surface 48 of the base platform 38 and the gas flow inlet 52. The bracket structure 62 further comprises a pair of guide members 70 and a spring member 72. The guide members 70 are elongated in the direction of an axis 74, and are located parallel to each other on opposite sides of the inlet 52. The guide members 70 each have an elongated planar guide surface 76. Each of the guide members 70 also has a glue location surface 78 and a recessed surface 80 defining a glue trap. The glue location surfaces 78 are located at respective opposite longitudinal ends of the guide members 70. The spring member 72 extends across the bracket structure 62 between the guide members 70. The spring member 72 is a flexible arm having a U-shape defined in part by a pair of parallel arm sections 82 extending in the direction of the axis 74, and in part by an arcuate arm section 84 connecting the parallel arm sections 82. The spring member 72 is flexible in the direction of the vertical axis 40 in response to vertical forces exerted on the arcuate arm section 84, as indicated by the arrow shown in FIG. 6.

Figure 7A:
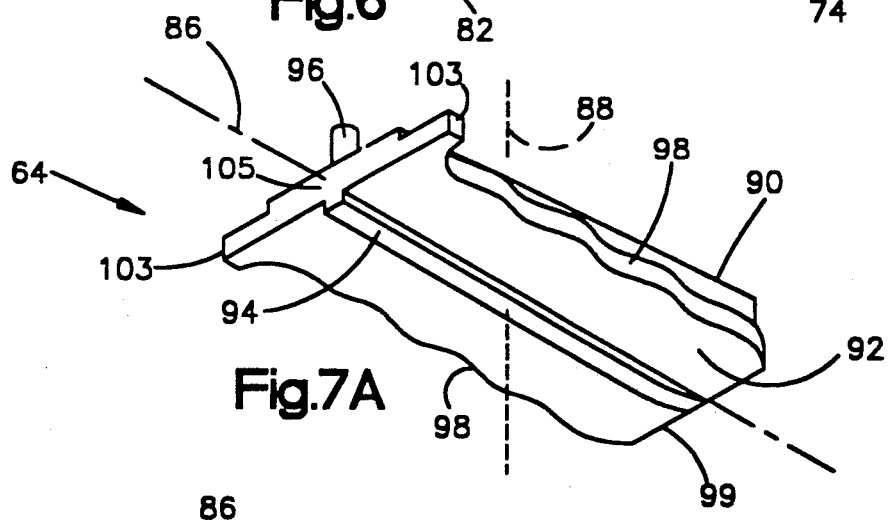
FIGS. 7A and 7B are perspective views of a part of the gas damped deceleration switch of FIG. 1.
Figure 7B:
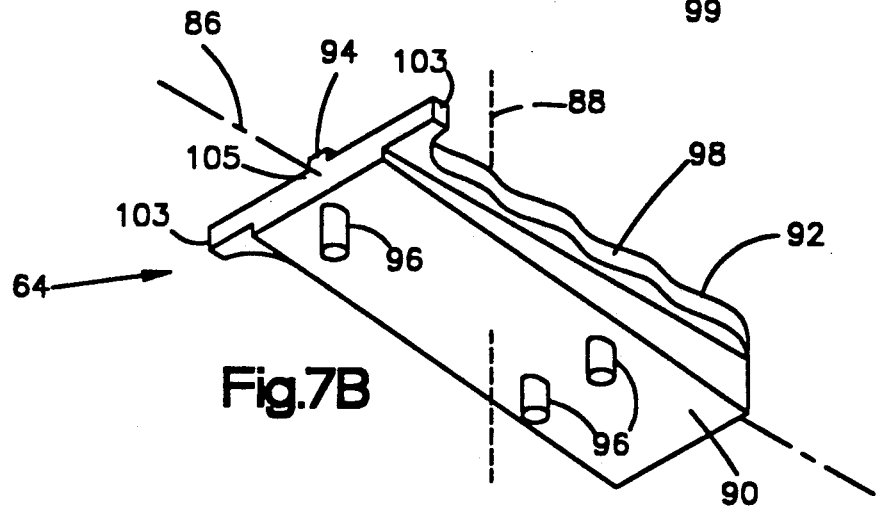

The control member 64 is shown in its upright position in FIG. 7A, and is shown in an overturned position for the purpose of illustration in FIG. 7B. The control member 64 comprises a substantially rectangular block having a horizontal longitudinal axis 86 and a vertical transverse axis 88. The control member 64 has an upper side surface 90 and a lower side surface 92. The lower side surface 92 extends in a horizontal plane parallel to the longitudinal axis 86. The upper side surface 90 extends in a plane which is inclined relative to the lower side surface 92 and the longitudinal axis 86. The control member 64 thus has a wedge-shaped cross sectional profile as shown in FIG. 1.

The control member 64 further comprises a centrally located rib 94 extending the length of the lower side surface 92, and three support posts 96 extending vertically from the upper side surface 90. Two of the support posts 96 are located near the middle of the control member 64, and are shorter than the single support post 96 located near one end of the control member 64. The control member 64 also has longitudinal edge surfaces 98 extending vertically upward from the lower side surface 92. The edge surfaces 98 have undulating contours as shown in FIGS. 7A and 7B.

With further reference to FIGS. 6, 7A, and 7B, the control member 64 is movable into the bracket structure 62 longitudinally into the space that extends horizontally between the guide members 70 and vertically between the spring member 72 and the bottom surface 48. When the control member 64 is moved longitudinally toward the bracket structure 62 from the left to the right as shown in FIGS. 6 and 7A, the curvature of the edge surfaces 98 at the leading end 99 of the control member 64 and the curvature of the end of the rib 94 assist in guiding the leading end 99 into the space between the guide members 70. A pair of projections 103 at the trailing end 105 of the control member 64 limit longitudinal movement of the control member 64 and provide for automated loading of the control member 64 into a production line. As shown in FIGS. 1-5, the control member 64 then takes an assembled position vertically and horizontally coaxial with the bracket structure 62. When in the assembled position, the edge surfaces 98 on the control member 64 are located adjacent to the elongated planar guide surfaces 76. The ends of the support posts 96 abut the bottom surface 48. The upper side surface 90 overlies the inlet 52, and is spaced from the inlet 52 and the bottom surface 48 by the support posts 96. The rib 94 is engaged with the spring member 72 at the apex of the arcuate section 84, and is biased by the spring member 72 upwardly as shown in the drawings. The spring member 72 thus holds the control member 64 in slidable contact with the bottom surface 48 on the base platform 38 so that the control member 64 can slide on the bottom surface 48 along the longitudinal axis 86. The bias of the spring member contributes to friction that resists sliding movement of the control member 64 on the bottom surface 48.

Importantly, the spring member 72 has a range of flexible vertical movement which permits it to accommodate a wide range of dimensional tolerance for mass produced control members 64, base platforms 38, and bracket structures 62. If the spring member 72 were forced to take a different vertical position holding a different control member against the bottom surface 48, the bias of the spring member 72, and the friction resisting sliding movement of the control member on the bottom surface 48, would not change substantially.

Referring again to FIGS. 1-5, the base 34 further comprises a pair of diametrically opposed supporting arms 100, 102 extending axially forward from the base platform 38. The supporting arms 100, 102 are similarly constructed. Each supporting arm 100, 102 includes a pair of side walls 104, only one of each pair being shown in the drawings. The side walls 104 are joined by a cross member 106 that extends across a space 108 between the side walls 104. The base platform 38 also includes first and second mounting portions 110, 112 (see FIG. 2) at diametrically opposed locations which are offset approximately 90° from the diametrically opposed locations of the supporting arms 100, 102. The mounting portions 110, 112 are similarly constructed. Each mounting portion 110, 112 comprises a pair of spaced apart radial projections 114, only one of each pair being shown in the drawings.

An arch assembly 120 is rigidly supported on the base 34. The arch assembly 120 includes a bridge member 122, a plastic molded member 124, and a flexible electrical contact leaf 126. The bridge member 122 comprises a first upright section 130, a second upright section 132, and a cross piece 134 extending between the first and second upright sections 130, 132. The first upright section 130 is rigidly supported on the base 34 at the first mounting portion 110, and the second upright section 132 is rigidly supported on the base 34 at the second mounting portion 112.

Figure 10:
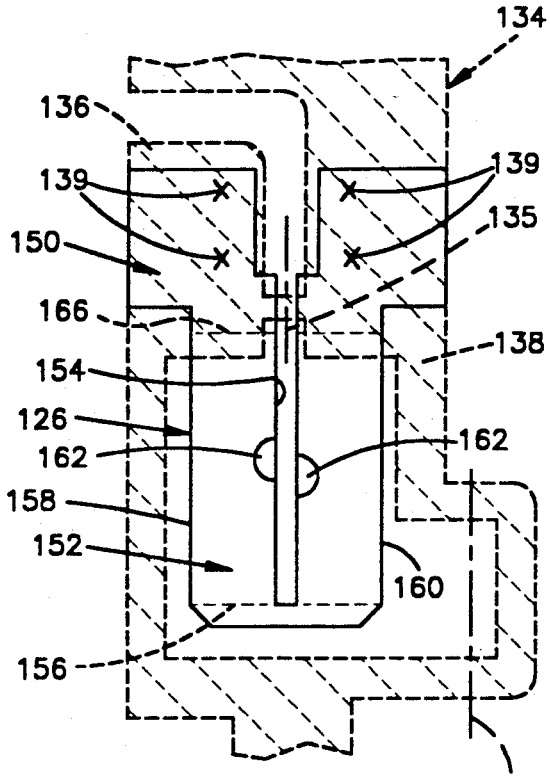
FIG. 10 is a plan view of a part of the gas damped deceleration switch of FIG. 1.

The plastic molded member 124 of the arch assembly 120 is molded around the cross piece 134 of the bridge member 122. The plastic molded member 124 includes a shoulder surface 140, and a cylindrical inner surface 142 defining a passageway 144 is coaxial with the passageway 50 extending through the base platform 38. After the plastic molded member 124 is molded around the cross piece 134, the cross piece 134 is cut along lines 135 as shown in FIG. 10 to divide the cross piece 134 into separate sections 136 and 138. The first section 136 is an extension of the first upright section 130 of the bridge member 122, and the second section 138 is an extension of the second upright section 132 of the bridge member 122.

Figure 2:
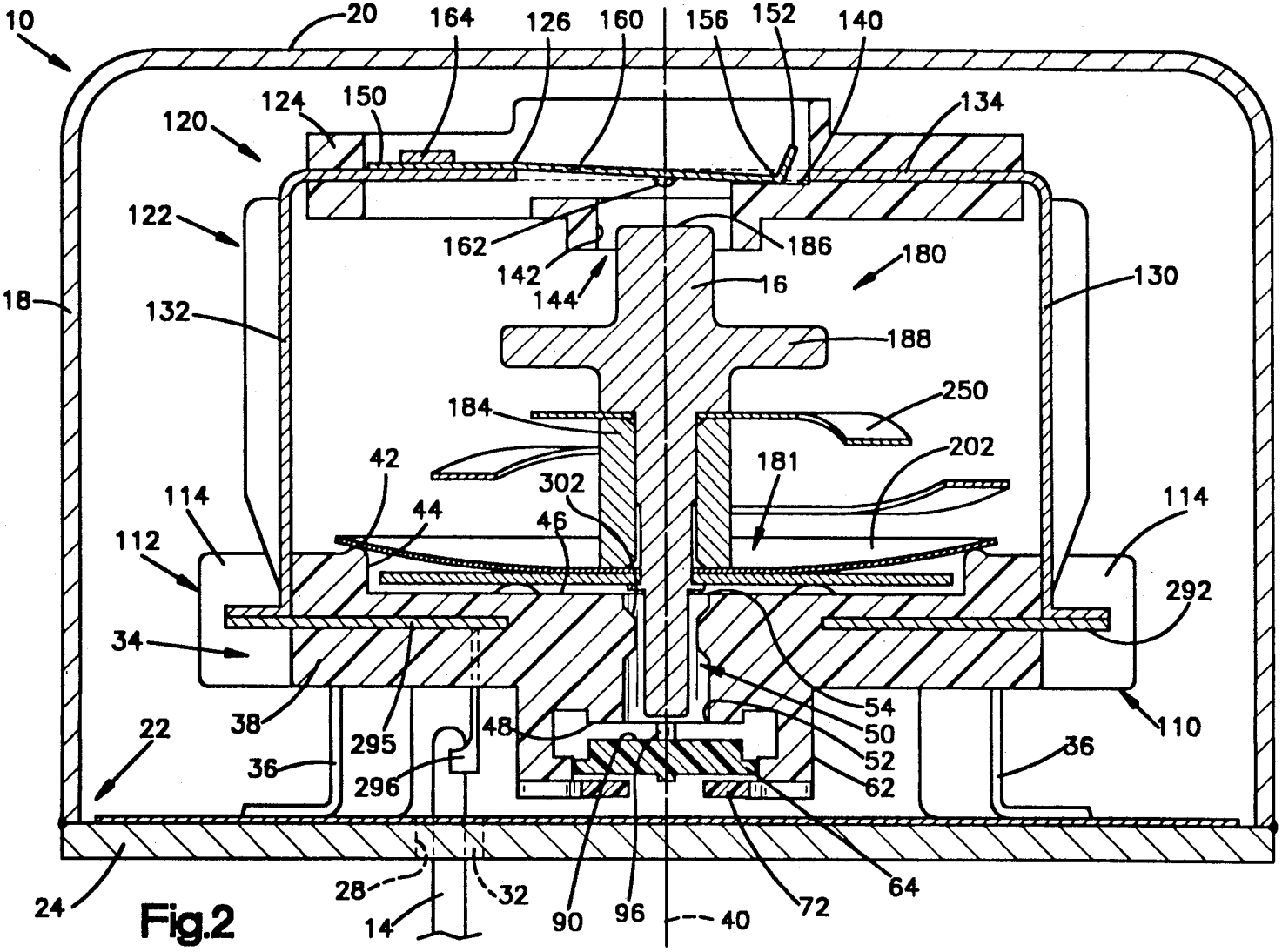
FIG. 2 is a sectional view taken on line 2—2 of FIG. 1.

As shown in FIGS. 2 and 10, the flexible contact leaf 126 is a rectangular piece of metal with a first end portion 150, a second end portion 152, and a centrally located slot 154 (FIG. 10) which extends from the first end portion 150 to a bend 156 (preferably 90° ) at the second end portion 152. The slot 154 defines two spaced apart sections 158, 160 of the flexible contact leaf 126. Each section 158, 160 has a downwardly extending dimple 162 at a position offset from the position of the other dimple The first end portion 150 of the flexible contact leaf 126 is clamped to the cross piece 134 of the bridge member 122 by a pair of contact retention tabs 164 (see FIG. 1) formed on the cross piece 134. Each section 158, 160 of the flexible contact leaf 126 is welded to a respective section 136, 138 of the cross piece 134 at welds 139 as shown in FIG. 10. The flexible contact leaf 126 thereby provides an electrically conductive connection between the first and second upright sections 130, 132 of the bridge member 122 through the sections 136, 138 of the cross piece 134.

The second end portion 152 of the flexible contact leaf 126 rests on the shoulder surface 140 of the plastic molded member 124. The flexible contact leaf 126 has an intermediate bend 166 such that the second end portion 152 is biased toward the shoulder surface 140. The second end portion 152 of the flexible contact leaf 126 can resiliently move axially back toward the shoulder surface 140 after being moved axially away from the shoulder surface 140.

The gas damped deceleration switch further comprises a mass assembly 180 including the mass 16 and a damping disk assembly 181 (see FIG. 1). The mass 16 comprises a body member 182 and a spacer 184. The body member 182 is circular in cross section, has an upper end surface 186, and defines a flange 188. The spacer 184 is a sleeve received over a portion of the body member 182. In the preferred embodiment of the invention, the body member 182 and the spacer 184 are formed of brass.

Figure 12:
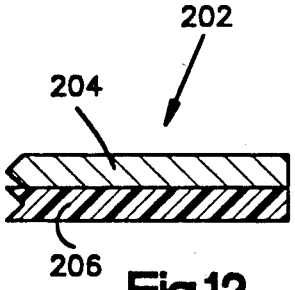
FIG. 12 is a partial sectional view of a component of the gas damped deceleration switch of FIG. 1.

The damping disk assembly 181 comprises a rigid damping disk 200, and a flexible damping disk 202 having a diameter greater than the diameter of the rigid damping disk 200. The flexible damping disk 202 comprises a spring disk layer 204 and a sealing disk layer 206, as shown in FIG. 12. The flexible damping disk 202 has a flat, planar unflexed condition in overlying surface contact with the rigid damping disk 200 prior to assembly in the deceleration switch.

Figure 8:
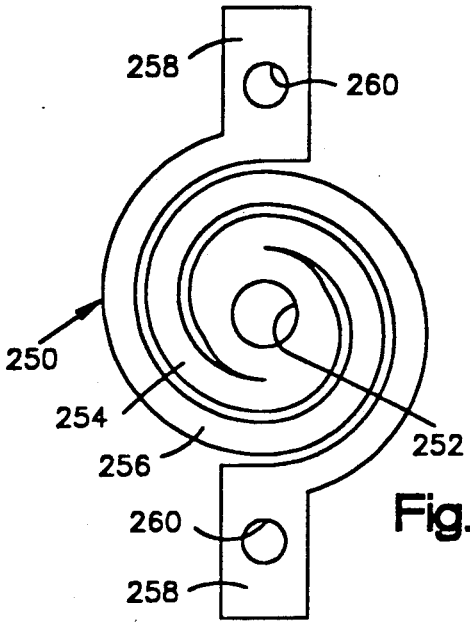
FIG. 8 is a plan view of a part of the gas damped deceleration switch of FIG. 1.

The elongated mass assembly 180 is attached to the base 34 by means of a spiral spring 250. As shown in FIG. 8, the spiral spring 250 has a central opening 252, and a pair of spiral legs 254, 256. Each of the spiral legs 254, 256 has a terminal portion 258 which includes a hole 260. As shown in FIG. 1, the spiral spring 250 is received coaxially over the mass 16, and is held in place by the spacer 184 and by welds (not shown). A respective spring adjustment screw 264 extends through each of the holes 260 in the terminal portions 258 of the spiral legs 254 and 256, and is received in a threaded opening 266 in the base 34. The spring adjustment screws 264, when rotated, move axially relative to the base 34 and adjust the axial loading of the spiral spring 250 on the elongated mass assembly 180.

The terminal portions 258 of the spiral legs 254 and 256 extend radially beyond the spring adjustment screws 264 into the spaces 108 between the side walls 104 of the supporting arms 100, 102 of the base 34. The elongated mass assembly 180 is thus supported for axial movement away from the base 34 against the bias of the spiral spring 250, and for return axial movement toward the base 34 under the bias of the spiral spring 250. The spiral spring 250 has a flat, planar unflexed condition prior to assembly in the deceleration switch.

A plurality of electrically conductive metal inserts are included in the base 34 to define a diagnostic circuit and a firing circuit. A first insert 282 (FIG. 1) extends from a pin connector portion 284 at the electrical pin 12 through the base platform 38, and further through the space 108 within the first supporting arm 100 to the cross member 106. The first insert 282 has a spring contact surface 286 against which a projected portion 258 of the spiral spring 250 is welded. A second insert 288 extends from the cross member 106 of the other supporting arm 102 through the other space 108 and into the base platform 38. The second insert 288 has a spring contact surface 290 against which the other projected portion 258 of the spiral spring 250 is welded. A third insert 292 (FIG. 2) extends from a position within the base platform 38 to a position outward of the base platform 38 in contact with the first upright section 130 of the bridge member 122 at the first mounting portion 110. An electrical resistor 294 connects the second insert 288 to the third insert 292. A fourth insert 295 extends from a position in contact with the second upright section 132 of the bridge member 122 at the second mounting portion 112 through the base platform 38 to a pin connector portion 296 to which the other electrical pin 14 is connected. Alternately, the third insert 292 could contact the second upright section 132, and the fourth insert 295 could extend from the first upright section 130.

Figure 9:
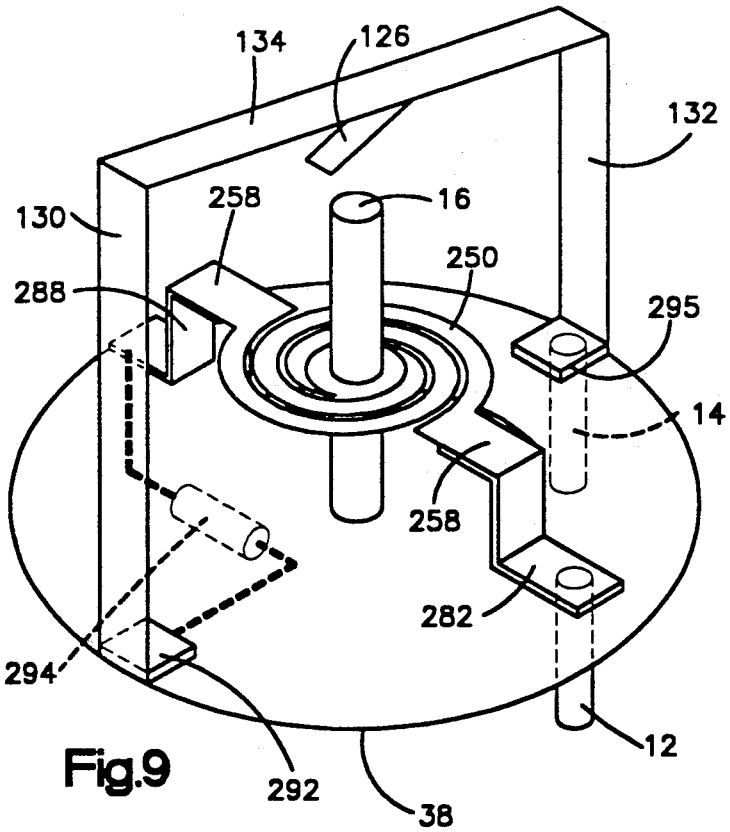
FIG. 9 is a schematic perspective view of the parts of the gas damped deceleration switch of FIG. 1 that carry electric current.

As shown schematically in FIG. 9, the diagnostic circuit follows a path from the electrical pin 12 through the first insert 282 to the spiral spring 250, across the spiral spring 250 through the mass 16, and further from the spiral spring 250 through the second insert 288. The diagnostic circuit continues through the resistor 294 from the second insert 288 to the third insert 292, from the third insert 292 across the bridge member 122 (through the contact leaf 126) to the fourth insert 295, and finally through the fourth insert 295 to the electrical pin 14. A diagnostic test current, when applied between the electrical pins 12 and 14 through the diagnostic circuit, is at a level below that which would activate the passenger safety device associated with the deceleration switch, as is known.

The firing circuit is normally open, and is closed when the mass 16 is moved axially into contact with the flexible contact leaf 126. The firing circuit follows the path of the diagnostic circuit from the first electrical pin 12 to the mass 16, but bypasses the resistor 294 by continuing from the mass 16 directly to the cross piece 134 of the bridge member 122 through the flexible contact leaf 126. The firing circuit then continues on a path from the bridge member 122 to the electrical pin 14 through the fourth insert 294 and the pin connector 296. The firing voltage, when applied between the electrical pins 12 and 14 and bypassing the resistor 294, results in a firing current which is at an elevated level sufficient to activate the passenger safety device.

Operation

The deceleration switch operates to activate a vehicle occupant safety device in response to a decelerating crash pulse experienced by a vehicle carrying the deceleration switch. Deceleration of the vehicle will urge the elongated mass assembly 180 to move inertially along the vertical axis 40 away from the base 34. If a decelerating crash pulse has sufficient magnitude and duration, the elongated mass assembly 180 will move from the rest position shown in FIGS. 1 and 2 past the successive positions shown in FIGS. 3 and 4, and to the firing position shown in FIG. 5. When the elongated mass assembly 180 is in the firing position, the mass 16 contacts the flexible contact leaf 126 to close the firing circuit to activate the vehicle occupant safety device. In the preferred embodiment, the mass 16 is movable 1.5 mm., plus or minus 0.3 mm., from the rest position into contact with the flexible contact leaf 126.

When the elongated mass assembly 180 is held in the rest position by the spiral spring 250 as shown in FIGS. 1 and 2, the damping disk assembly 181 is in an initial position. The rigid damping disk 200 is held against four supporting pads 300 on the recessed surface 46 of the base platform 38, and the sealing disk layer 206 of the flexible damping disk 202 is held against the circular rim 42 o the base platform 38. The spring disk layer 204 is biased by the spiral spring 250 to flex inwardly of cavity in the base platform 38, and holds the sealing disk layer 206 against the circular rim 42 due to the tendency of the spring disk layer 204 to return to its originally flat, unflexed condition. The sealing disk layer 206 provides a continuous gas seal between the flexible damping disk 202 and the rim 48. For this purpose, the sealing disk layer 206 is preferred to be formed of the material known by the trademark Kapton, a trademark of E. I. DuPont de Nemours and Company. An initial control volume is defined within the cavity between the recessed surface 46 of the base platform 38 and the flexible damping disk 202 when the damping disk assembly 181 is in the initial position. The flexible damping disk 202 serves as a movable boundary wall for the control volume.

Figure 3:
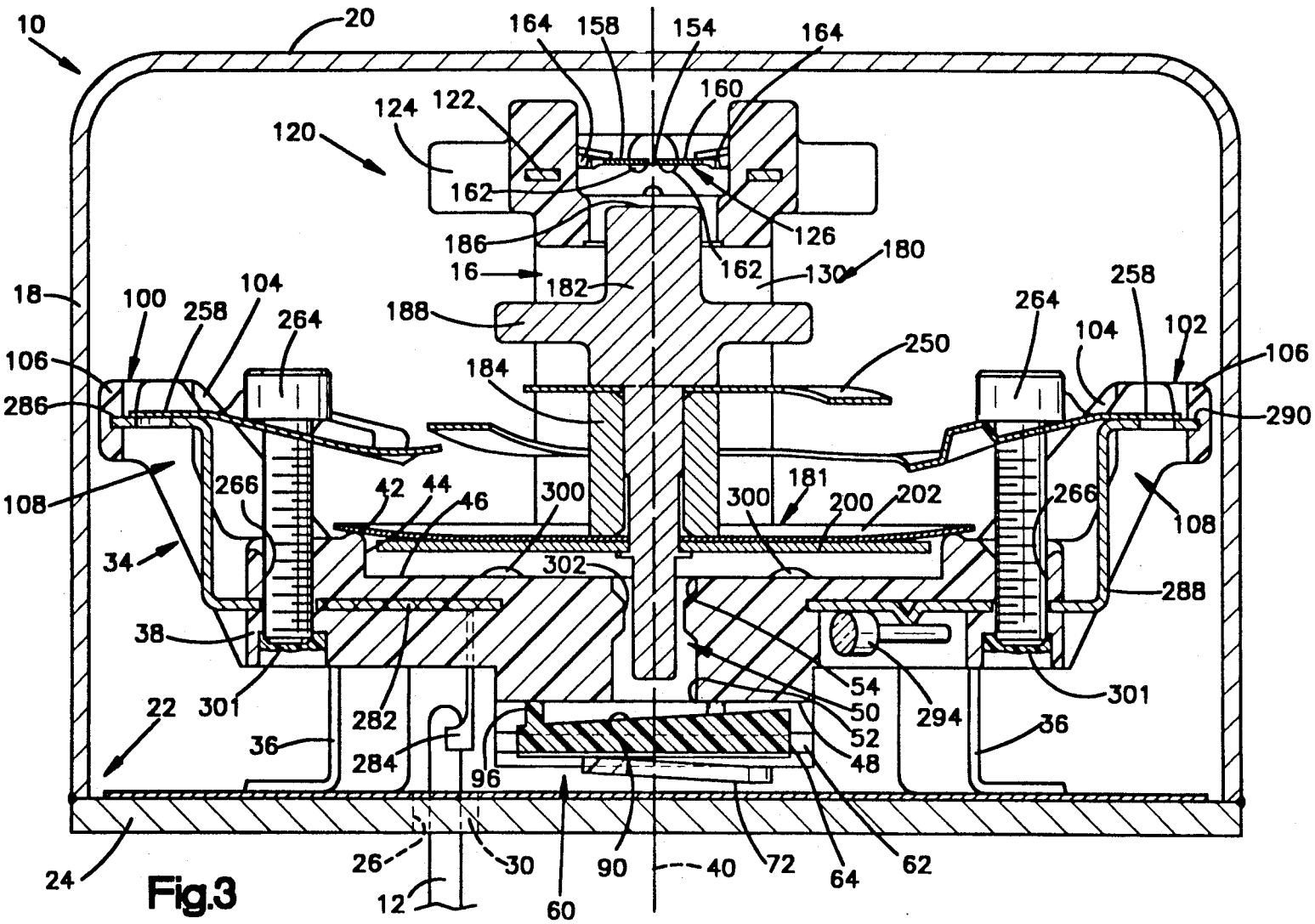
FIGS. 3, 4 and 5 are sectional views of the gas damped deceleration switch of FIG. 1 illustrating parts in different positions.
Figure 4:
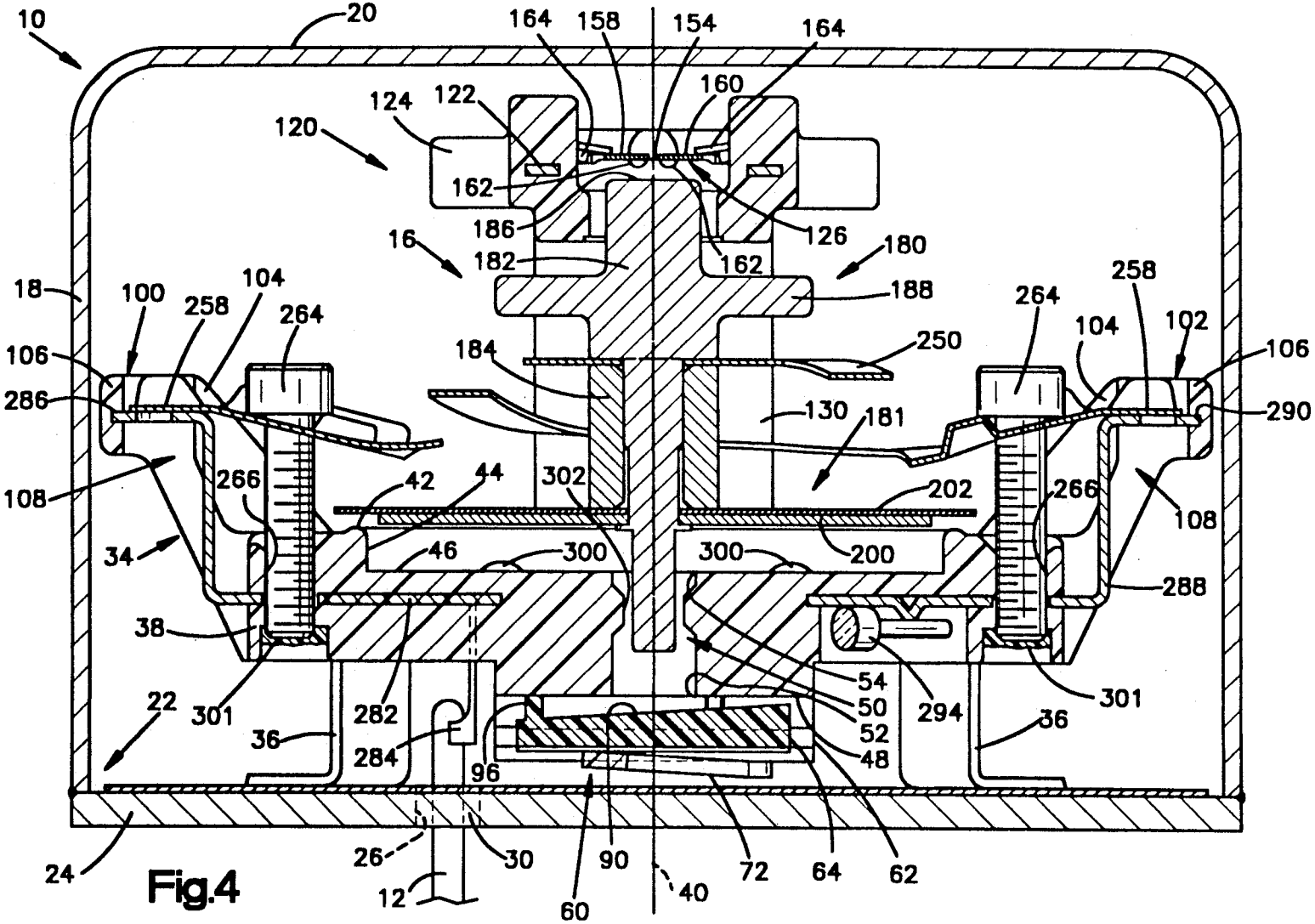
Figure 5:
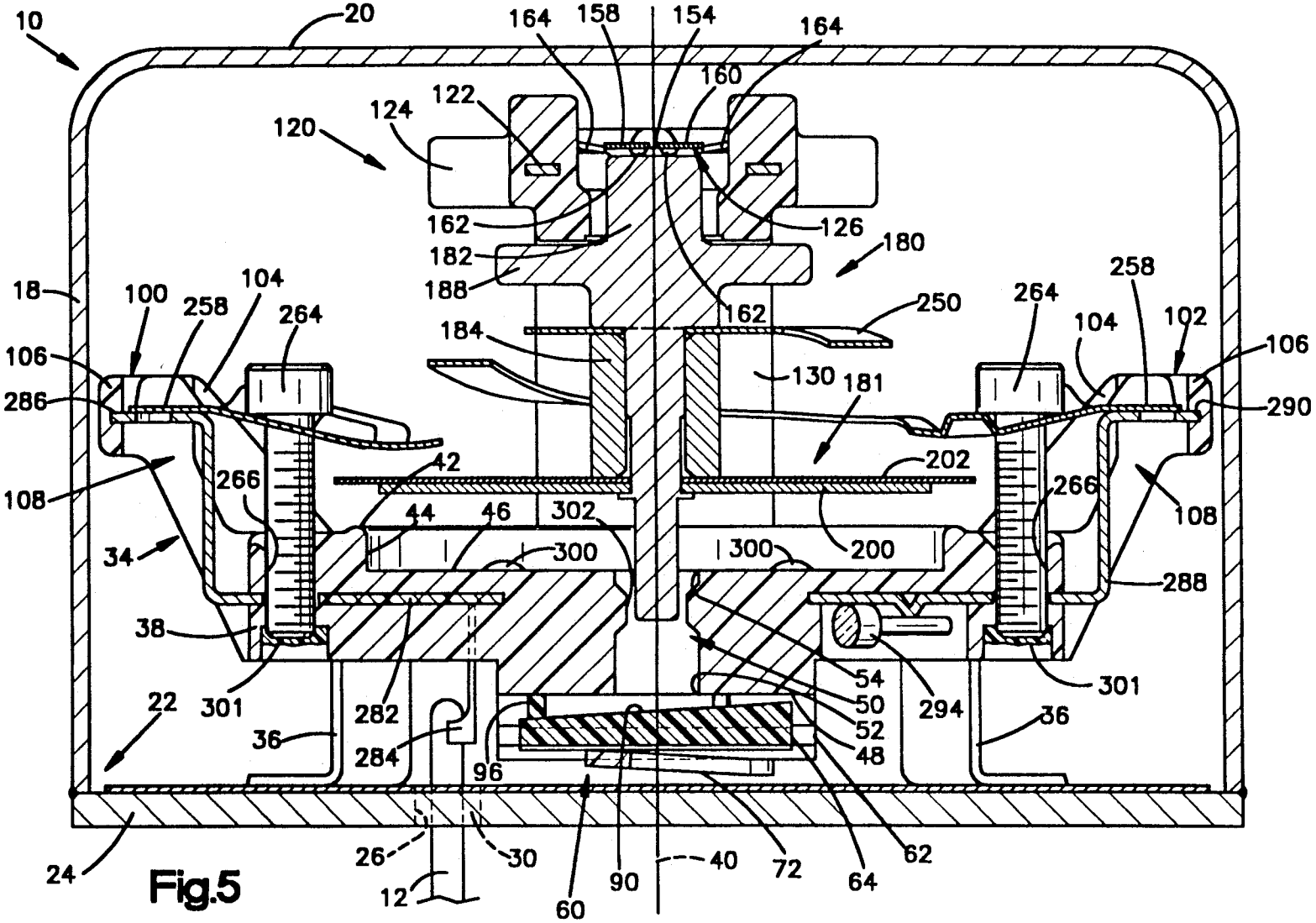

When the elongated mass assembly 180 is moved from the rest position shown in FIGS. 1 and 2 to the position shown in FIG. 3, the damping disk assembly 181 is carried with the moving mass 16 from the initial position shown in FIGS. 1 and 2 to the advanced position shown in FIG. 3. When the damping disk assembly 181 is in the advanced position, the spring disk layer 204 still holds the sealing disk layer 206 firmly against the rim 42, but is resiliently flexed back from its initial position toward its flat, unflexed condition. An advanced control volume greater than the initial control volume is then defined within the cavity. Flexing of the spring disk layer 204 back toward its unflexed condition moves it axially relative to the rigid damping disk 200 such that the rigid damping disk 200 is moved into greater overlying surface contact with the flexible damping disk 202.

Upon further axial movement of the elongated mass assembly 180 away from the base 34 beyond the position shown in FIG. 3, the rigid damping disk 200 will fully engage the flexible damping disk 202 to move the sealing disk layer 206 out of engagement with the rim 42. The damping disk assembly 181 then occupies the open position shown in FIG. 4, and the flexible damping disk 202 returns to its unflexed condition as the elongated mass assembly 180 continues toward the firing position shown in FIG. 5. The flange 188 on the mass 16 limits forward axial movement of the elongated mass assembly 180, and guide ribs 302 in the passage 50 limit lateral displacement of the elongated mass assembly 180.

Damping gas contained within the housing 10 will exert a damping force against the moving flexible damping disk 202. Movement of the damping disk assembly 181 from the initial position to the advanced position enlarges the control volume. This causes a reduction in the pressure of the gas contained within the control volume. The pressure reduction causes the damping gas in the housing 10 to exert an increased damping force against the upper surface of the moving flexible damping disk 202. Also, the pressure reduction creates a relative vacuum within the control volume that causes a flow of gas to be directed into the control volume through the passageway 50.

Moving vehicles sometimes experience a hammer blow type of deceleration pulse upon impact with an object or an uneven road surface. A hammer blow deceleration pulse may have a magnitude equal to or greater than the magnitude of an actual crash pulse in terms of deceleration, but will have a duration substantially less than the duration of an actual crash pulse. A deceleration switch should not activate a passenger safety device such as an airbag inflator in response to a hammer blow deceleration pulse, and therefore should not close the firing circuit in response to a deceleration pulse having an elevated magnitude and a low duration indicative of a hammer blow against the vehicle. In accordance with the present invention, operation of the deceleration switch as shown in the FIGS. is calibratable to maximize resistance of the mass 16 against movement into contact with the flexible contact leaf 126 in response to a hammer blow deceleration pulse.

Calibration of the deceleration switch is accomplished with the gas damping control assembly 60. As shown in FIG. 1, the inclined upper side surface 90 of the movable control member 64 is spaced a distance vertically from the bottom surface 48 on the base platform 38 and from the inlet 52 to the gas flow passageway 50. The control member 64 thus defines a space for gas to flow to the inlet 52 between the upper side surface 90 of the control member 64 and the bottom surface 48 of the base platform 38. If the control member 64 were moved to the left from the position shown in FIG. 1, the upper side surface 90 would be spaced vertically closer to the inlet 52. The gas flow space between the upper side surface 90 and the inlet 52 would then be reduced in size, and the gas flow through that space would be relatively restricted. If the control member 64 were moved to the right from the position shown in FIG. 1, the upper side surface 90 would be spaced vertically farther from the inlet 52. The gas flow space would then be enlarged and the flow of gas would be relatively increased. The position of the movable control member 64 thus affects and controls the rate of the gas flow directed through the gas flow passageway 50 in response to deceleration.

Adjustment of the position of the movable control member 64 to enlarge the space for gas to flow to the inlet 52, and to increase the flow rate of gas directed into the vacuum through the passageway 50, will decrease the time required for the flow of gas to relieve a given vacuum. For a deceleration pulse having a given magnitude, this will decrease the pulse duration required to move the elongated mass assembly 181 into the open position against the damping force caused by generation of the vacuum. Adjustment of the position of the movable control member 64 to reduce the space for gas to flow to the inlet 52, and to decrease the flow rate of gas directed into the vacuum through the passageway 50, will increase the time required for the flow of gas to relieve a given vacuum. For a deceleration pulse having a given magnitude, this will increase the pulse duration required to move the elongated mass assembly 181 into the open position against the damping force caused by generation of the vacuum. The deceleration switch is thus calibratable to control closing of the firing circuit by adjustment of the position of the movable control member 64.

Figure 11:
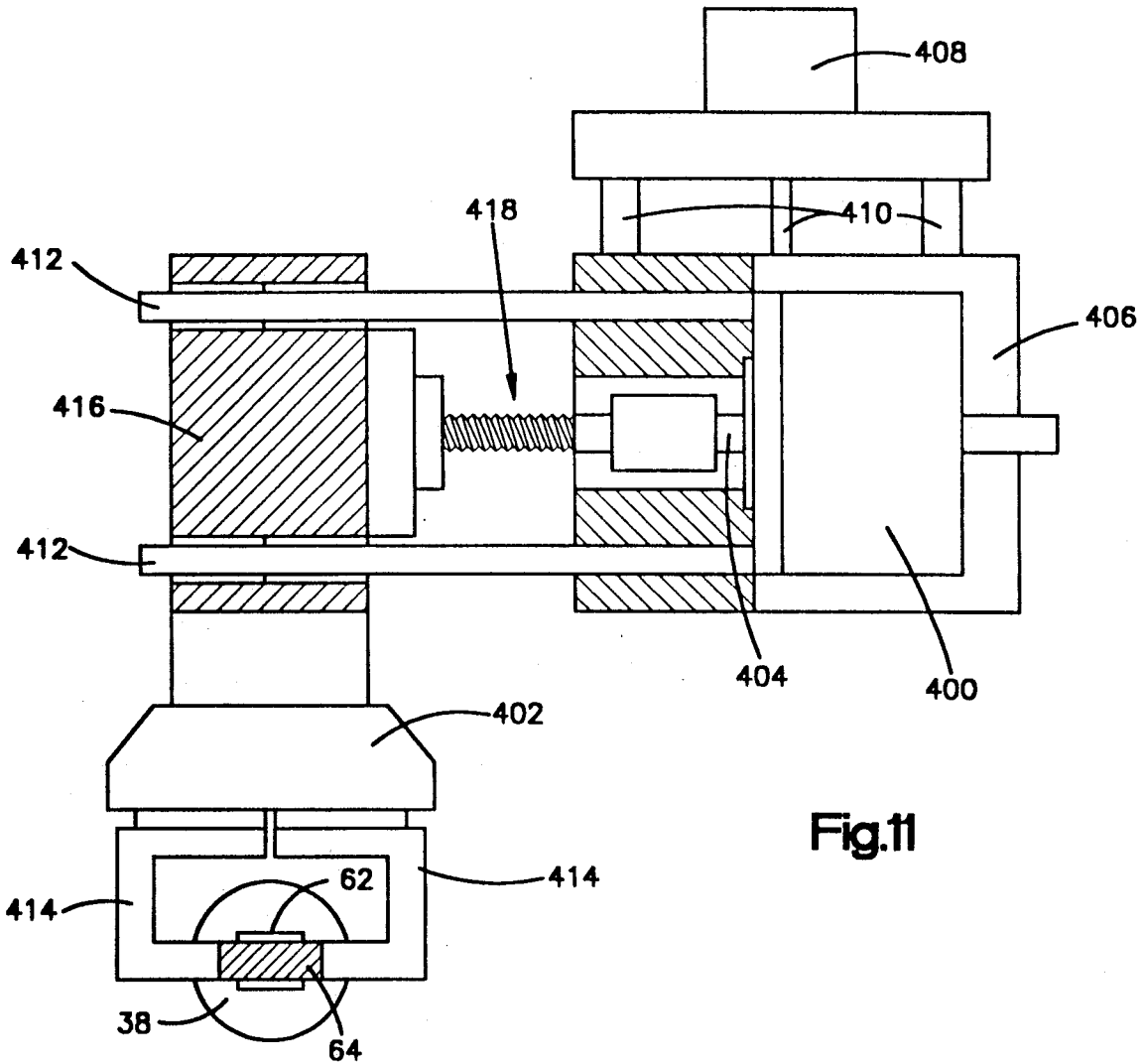
FIG. 11 is a schematic view of a system for automatically calibrating the gas damped deceleration switch of FIG. 1.

A system for automatic adjustment of the position of the control member 64 is shown in FIG. 11. The system comprises a microstepping electric motor 400 and a parallel motion gripper 402. The motor 400 has a rotatable output shaft 404, and is mounted on a first block 406. The first block 406 is connected to an air pressure cylinder 408 by parallel vertical shafts 410. A pair of parallel horizontal shafts 412 extend from the first block 406. The motor 400, the first block 406, and the horizontal shafts 412 are thus supported for vertical movement under the influence of the cylinder 408.

The gripper 402 comprises a pair of gripper arms 414, and is mounted on a second block 416. The second block 416 is slidably supported on the horizontal shafts 412, and is connected to the output shaft 404 at the motor 400 by a threaded coupling 418. The second block 416 and the gripper 402 are thus supported for horizontal movement relative to the motor 400 in response to rotation of the output shaft 404 by the motor 400.

When the deceleration switch is supported at a fixed work station (not shown), the gripper 402 is moved horizontally and vertically by the motor 400 and the cylinder 408 into a position adjacent to the base platform 38. The gripper arms 414 are then moved into engagement with respective opposite longitudinal ends of the control member 64, as shown in FIG. 11. Subsequent horizontal movement of the second block 416 and the gripper 402 under the influence of the motor 400 moves the control member 64 longitudinally into a desired calibrated position.

When calibration of the deceleration switch is complete, glue is applied between the undulating edge surfaces 98 on the control member 64 and the planar guide surfaces 76 on the bracket structure 62 at the glue location surfaces 78. The glue traps defined by the recessed surfaces 80 stop wicking so that the glue will not interfere with the calibrated setting of the control member 64. In accordance with a particular feature of the present invention, the glue location surfaces 78 and the undulating contours of the edge surfaces 98 on the control member 64 enable the cured glue to act as a mechanical interlock between the control member 64 and the bracket structure 62 if the glue does not adhere entirely to both the elongated planar guide surfaces 76 and the edge surfaces 98.

It is also desirable to avoid closing of the firing circuit in response to a hard braking deceleration pulse having a relatively low magnitude but a long duration indicative of an actual crash pulse. The spring adjustment screws 264 can be adjusted to increase or decrease the axial loading of the spiral spring 250 on the elongated mass assembly 180. The deceleration switch can thereby be adjusted so that the elongated mass assembly 180 will be movable into the firing position only by a deceleration pulse having a magnitude greater than the magnitude of a hard braking deceleration pulse. An adhesive 301 can be applied to hold the spring adjustment screws at a desired setting in the threaded openings 266 in the base 34.

The preferred embodiment of the invention comprises an electrical gas damped deceleration switch. It should be noted that the invention is not limited in scope to a gas damped deceleration switch having electrical rather than solely mechanical means for responding to movement of a mass, into an activated position in response to deceleration. For example, the invention could be employed in a gas damped deceleration switch having a responding means for igniting explosive or pyrotechnic materials to send an explosive or pyrotechnic signal to a vehicle occupant safety device. Such a responding means is disclosed in U.S. Pat. No. 4,092,926, entitled "Mechanical Rolamite Impact Sensor". In the present patent application, the electrical components of the preferred switch are not critical to the gas damping functions with which the claimed invention is concerned.

From the above description of the invention, those skilled in the art will perceive improvements, changes and modifications. Such improvements, changes and modifications within the skill of the art are intended to be covered by the appended claims.

Having described the invention, the following is claimed:

1. An apparatus comprising:

a movable mass;

means for supporting said mass for movement in response to deceleration;

a base structure having surfaces defining a chamber and a gas flow inlet communicating with said chamber, said chamber having an initial volume and a movable boundary wall connected to said mass for movement with said mass in response to deceleration, said movement of said boundary wall increasing the volume of said chamber to cause a pressure reduction in said chamber, said pressure reduction restraining movement of said boundary wall and said mass and causing a flow of gas into said chamber through said inlet; and means for controlling said pressure reduction and said movement of said mass by adjusting said flow of gas into said chamber through said inlet, said controlling means comprising a movable control member overlying said inlet, and means for supporting said control member for movement relative to said base structure in a direction across said inlet to control a flow of gas to said inlet past said control member.

2. An apparatus as defined in claim 1 further comprising spring means for biasing said control member toward said base structure.

3. An apparatus as defined in claim 2 wherein said spring means biases said control member into slidable contact with said base structure.

4. An apparatus as defined in claim 3 wherein said supporting means comprises a bracket supported on said base structure, said spring means comprising a flexible arm of said bracket extending across said control member.

5. An apparatus as defined in claim 4 wherein said control member urges said flexible arm to flex in a direction away from said inlet.

6. An apparatus as defined in claim 5 wherein said flexible arm comprises a pair of parallel arm sections and an arcuate arm section connecting said parallel arm sections, said control member comprising an elongated rib, said rib being held in slidable contact with said arcuate arm section by said bias of said spring means.

7. An apparatus as defined in claim 1 wherein said control member has a longitudinal axis extending in said direction of movement, and a control surface inclined relative to said longitudinal axis said control surface being spaced a distance from said inlet in a direction transverse to said longitudinal axis, said movement of said control member changing said distance.

8. An apparatus as defined in claim 7 wherein said control means further comprises support posts extending from said control surface to said base structure, said support posts spacing said control surface from said inlet and defining a space for gas to flow to said inlet between said control surface and said base structure.

9. An apparatus as defined in claim 8 wherein said support posts include posts having different lengths.

10. An apparatus as defined in claim 9 wherein said control surface is a planar surface.

11. An apparatus as defined in claim 1 further comprising means for defining an electrical current path in said deceleration switch, and for enabling electric current to flow along said current path in response to a predetermined amount of said movement of said mass.

12. An apparatus as defined in claim 1 further comprising means for activating a vehicle occupant safety apparatus in response to a predetermined amount of said movement of said mass.

13. An apparatus comprising:

a movable mass;

means for supporting said mass for movement in response to deceleration;

a structure having surfaces defining a chamber and a gas flow inlet communicating with said chamber, said chamber having an initial volume and a movable boundary wall connected to said mass for movement with said mass in response to deceleration, said movement of said boundary wall increasing the volume of said chamber to cause a pressure reduction in said chamber, said pressure reduction restraining movement of said boundary wall and said mass and causing a flow of gas into said chamber through said inlet; and means for controlling said pressure reduction and said movement of said mass by adjusting said flow of gas into said chamber through said inlet, said controlling means comprising a first surface on said structure surrounding said inlet, a movable control member having a second surface overlying said inlet and said first surface, said second surface being spaced from said first surface to define a space for gas to flow to said inlet between said first and second surfaces, and means supporting said control member for movement relative to said structure in a lateral direction across said inlet to change the size of said space.

14. An apparatus as defined in claim 13 wherein said control member has an axis extending in said lateral direction, said supporting means supporting said control member for movement back and forth along said axis, said second surface being inclined relative to said axis.

15. An apparatus as defined in claim 14 wherein said second surface is spaced a distance from said inlet in a direction transverse to said axis, said movement of said control member along said axis changing said distance.

16. An apparatus as defined in claim 15 wherein said supporting means supports said control member in contact with said structure to slide across said structure along said axis.

17. An apparatus as defined in claim 16 wherein said supporting means comprises spring means for biasing said control member against said structure.

18. An apparatus as defined in claim 17 wherein said spring means applies a force against said control member in said transverse direction.

19. An apparatus as defined in claim 13 wherein said second surface is a planar surface.

20. An apparatus as defined in claim 13 further comprising means for defining an electrical current path and for enabling electric current to flow along said current path in response to a predetermined amount of said movement of said mass.

21. An apparatus as defined in claim 13 further comprising means for activating a vehicle occupant safety apparatus in response to a predetermined amount of said movement of said mass.

* * * * *